US005500632A

United States Patent [19]

Halser, III

[11] Patent Number: 5,500,632

[45] Date of Patent: Mar. 19, 1996

[54] WIDE BAND AUDIO TRANSFORMER WITH MULTIFILAR WINDING

[76] Inventor: Joseph G. Halser, III, 5905 S. Howell Ave., Milwaukee, Wis. 53207

[21] Appl. No.: 241,203

[22] Filed: May 11, 1994

[51] Int. Cl.[6] ..... H01F 27/28

[52] U.S. Cl. ..... 336/180; 336/183; 336/186; 336/205

[58] Field of Search ..... 336/200, 205, 336/180, 183, 205, 206, 69, 70

[56] References Cited

U.S. PATENT DOCUMENTS

| | | | |
|---|---|---|---|
| 2,477,074 | 7/1949 | McIntosh . | |
| 2,680,218 | 6/1954 | Keroes . | |
| 2,791,646 | 5/1957 | Keroes . | |
| 3,061,804 | 10/1962 | Bereskin . | |
| 3,102,245 | 8/1963 | Lawson, Jr. | 336/200 |
| 3,168,715 | 2/1965 | Woodworth . | |
| 3,895,335 | 7/1975 | Manimalethu | 336/183 |
| 4,311,977 | 1/1982 | Owen . | |
| 4,631,511 | 12/1986 | Sylvester, Jr. et al. | 336/180 |
| 4,755,783 | 7/1988 | Fleischer et al. | 336/180 |
| 4,847,984 | 7/1989 | Rossi et al. | 336/200 |

FOREIGN PATENT DOCUMENTS

| | | | |
|---|---|---|---|
| 2445143 | 4/1976 | Germany | 336/180 |
| 2541871 | 3/1977 | Germany | 336/205 |

OTHER PUBLICATIONS

Is the Output Transformer Out? by Herbert Ravenswood, Radio–Electronics Jan., 1958, pp. 81–84.

*Primary Examiner*—Thomas J. Kozma
*Attorney, Agent, or Firm*—Andrus, Sceales, Starke & Sawall

[57] ABSTRACT

An output transformer for use with a push-pull vacuum tube amplifier using a multifilar ribbon in which primary windings and secondary windings co-exist. The multifilar ribbon is wound continuously around a common core side-by-side to form successive layers. The primary windings are connected in series by turning the multifilar ribbon after the layers of multifilar ribbon have been wound and connecting the turned end of the multifilar ribbon to the beginning end of the multifilar ribbon. The winding scheme increases the coupling between the first half primary, the second half primary and the secondary without reducing performance at high frequencies. The secondary windings are connected in series or in parallel to obtain the proper turns ratio for the transformer. A method of interconnecting the secondary windings for different turns ratios is also provided.

1 Claim, 4 Drawing Sheets

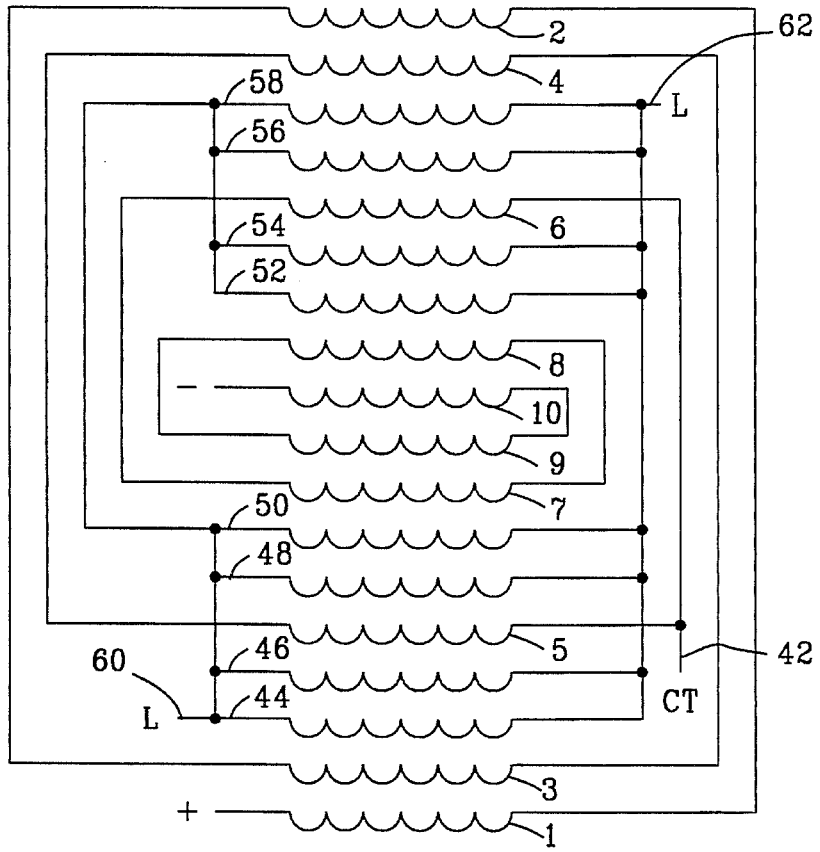
FIG. 5
FIG. 6
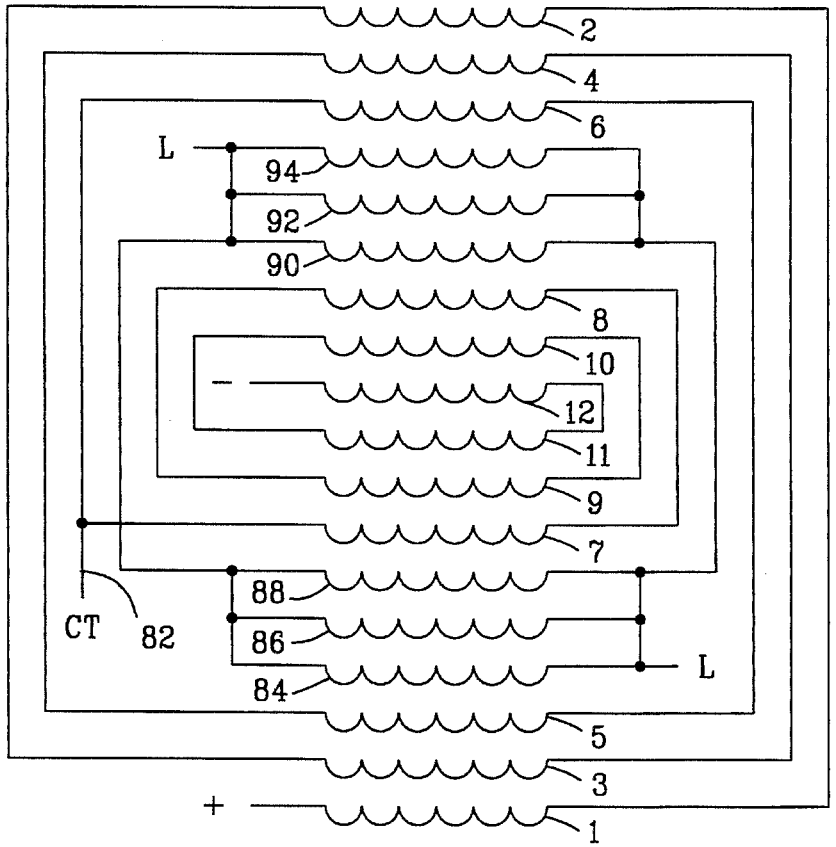

WIDE BAND AUDIO TRANSFORMER WITH MULTIFILAR WINDING

FIELD OF THE INVENTION

The present invention relates to transformers, and in particular, to output transformers for use with push-pull vacuum tube audio amplifiers.

BACKGROUND OF THE INVENTION

Audio systems with vacuum tube amplifiers are still commercially available even though most modem audio systems typically use solid state transistors. Nonetheless, many people still prefer vacuum tube amplifiers because they enjoy the sound produced by the vacuum tube amplifiers, because they enjoy the lights of the vacuum tubes, or for other reasons. One type of popular vacuum tube amplifier uses a push-pull circuit.

In a push-pull circuit one vacuum tube amplifies the positive half of an input signal while another vacuum tube amplifies the negative half of the input signal. Both halves of the signal are ultimately combined in the secondary of an output transformer. The secondary provides power to the speaker-load typically at high currents and low voltages. A conventional push-pull output transformer comprises three windings wound around a magnetic core: a half primary winding for each half of the input signal and a secondary winding for the speaker load.

The output transformer has limited the usefulness and applicability of the push-pull amplifier because the output transformer limits frequency response at the upper and lower ends of the audio spectrum, and also introduces notch distortion. In order for an output transformer to respond properly at low frequencies, a large number of turns in the primary is needed to produce a large inductance. Unfortunately, a large number of turns in the primary increases the distributed capacitance between the windings and also increases leakage inductance, both of which effect high frequency response. Thus, while increasing the number of turns in the primary improves performance for low frequencies, it sacrifices performance at high frequencies.

Another problem introduced by the output transformer when used in an amplifier operating the output tubes class AB2 or class B is notch distortion. Notch distortion cannot be eliminated by overall feedback. Vacuum tubes in push-pull arrangements such as Class AB, or B are more efficient than class A amplifiers, but notch distortion can occur at the point where one of the tubes stops conducting and the other tube begins conducting. Notch distortion is due to imperfect coupling between the two halves of the primary when the impedance of the source of the primary is high. Notch distortion does not usually show up below 1000 Hz and becomes excessive starting at about 3000 Hz.

In 1949, Macintosh disclosed a "unity coupled circuit" that allowed the output tubes to operate in parallel through a bifilar winding, effectively eliminating notch distortion. But, the unity- coupled circuit requires extensive positive feedback to overcome degenerative cathode swings causing problems yet more difficult to solve. Other attempts to reduce source impedance include the single ended push-pull circuit, the Peterson Sinclair circuit, and the Wiggins Circlotron circuit.

Another way to eliminate notch distortion would be to provide a transformer for a conventional push-pull circuit that is tightly coupled between the two half primaries. It is generally felt that a ratio of the open circuit primary inductance to the leakage inductance of 80,000:1 would substantially eliminate notch distortion. It is therefore desirable to provide a transformer with reduced leakage inductance that can accomplish this 80,000:1 ratio.

Bifilar windings of the two half primaries are known in the art to reduce leakage inductance, but these bifilar windings have introduced problems into output transformer design. One problem is that high AC potential exists between adjacent wires of the bifilar windings, so the wires must be adequately insulated to withstand the potential. Also, bifilar windings create considerable capacitance between adjacent wires, and that capacitance must be charged in developing potential difference between the wires. The charging current must be supplied by the output tubes, and this limits the high frequency power output of the amplifier.

In a transformer with bifilar primary windings, each winding has capacitance with respect to the two windings on each side of it in the same layer, and also with respect to windings in the layers above it and below it. Effective capacitance between windings in the same layer may be cut in half by transposing windings of the bifilar pair at every turn. Capacitance between wires in adjacent layers may be reduced by increasing the spacing between layers, but this increases the leakage inductance of the transformer.

Thus, in order to improve performance at the upper and lower ends of the audio system and to reduce notch distortion, it is desirable to provide a transformer with sufficiently low leakage inductance (i.e., a ratio of open circuit primary to leakage inductance of greater than 80,000:1) without substantially increasing distributed capacitance. In other words, it is desirable to increase coupling between the windings without increasing the capacitance.

SUMMARY OF THE INVENTION

The present invention is a wide band audio transformer in which the primary and secondary coexist in a multifilar ribbon that is wound around a core side-by-side and layer-by-layer. The multifilar ribbon consists of several adjacent windings, each winding preferably being made of wire of the same size or gauge. The multifilar ribbon is wound side-by-side through successive layers and then re-enters the transformer structure at the beginning in order to connect each of the primary windings in the multifilar ribbon in series. The number of series connected primary windings compared to the number of series or parallel connected secondary windings is the turns ratio for the transformer.

More than two primary windings are used to prevent the AC potential between adjacent windings in the multifilar ribbon from becoming too high, thus reducing the effects of distributed capacitance. It is preferred that there be 10 or more primary windings in the multifilar ribbon although the invention is not limited to the same. Several secondary windings are included in the multifilar ribbon to provide enough current handling capacity in the secondary and to provide sufficient coupling between the primary and the secondary. To reduce AC potential differences, it is preferred that the secondary windings be located in the ribbon multifilar adjacent or closest to the center tap of the primary.

It is further preferred that the primary windings in the multifilar ribbon be in an order that reduces the AC potential difference between adjacent turns of the multifilar ribbon. Such a winding pattern can be accomplished by locating each successive winding alternately from the outermost winding inward. Such a pattern also facilitates transformer fabrication because the ribbon only needs to be turned once to make the proper series connection.

The invention results in tight coupling between the windings. This reduces notch distortion and also reduces phase shift. Coupling is improved because the primary and secondary windings are wound side-by-side in the multifilar ribbon. This is in contrast to conventional transformers where coupling is typically increased by sandwiching alternating layers of primary windings and secondary windings.

The invention also reduces leakage inductance without increasing distributed capacitance. Distributed capacitance is controlled by using triple build magnet wire, and thick interleaving material between layers. The use of thick interleaving layers does not affect leakage inductance because coupling is provided by the multifilar ribbon. Also, capacitance associated with the multifilar ribbon are in series, which tend to substantially reduce capacitance. Furthermore, the effects of capacitance are minimized because the total primary AC potential is divided by the number of primary windings involved.

The use of bifilar primary windings in wide band transformers is well known, but these transformers have had problems related to the extremely high AC potential difference between adjacent wires. In these transformers, ordinary magnet wire wound in contact with an adjacent wire was impractical because of high capacitance. The present invention eliminates this problem because the AC potential difference between adjacent wires in the multifilar ribbon is substantially less, and this allows the secondary to be wound with the primary.

It is, accordingly, an object of the invention to provide a novel and improved wide band high quality audio transformer.

Another object of the invention is to provide a push-pull audio transformer capable of reducing leakage inductance without substantially increasing distributive capacitance.

Another object of the invention is to provide a transformer that has improved performance at both low and high frequencies.

Another objective of the invention is to provide an audio transformer in which the ratio of the open circuit primary inductance to the half primary to half primary inductance is greater than or equal to 80,000:1. It is generally believed that such a transformer would reduce notch distortion.

Another object of the invention is to provide a transformer that extends the amount of feedback that can be used, and reduces phase shifts that could cause amplifier instability.

The above and still further objects, features and advantages of the invention will become apparent upon consideration of the following detailed description of specific embodiments thereof, especially when taken in conjunction with the accompanying drawings.

BRIEF DESCRIPTION OF THE DRAWINGS

FIG. 3(*c*) is a schematic drawing like FIG. 3(*a*) except the transformer turns ration is 12:1.

FIG. 3(*c*) is a schematic drawing like FIG. 3(*a*) and (*b*) except the transformer turns ratio is 20:1.

FIG. 5 is a schematic diagram representing electrical connections between the primary and secondary windings of a transformer having a turns ratio of 10:1 as shown in FIG. 3(*a*).

FIG. 6 is a schematic diagram representing electrical connections between the primary and secondary windings of a transformer having a turns ratio of 12:1 as shown in FIG. 3(*b*).

DESCRIPTION OF THE PREFERRED EMBODIMENT

Figure 1:
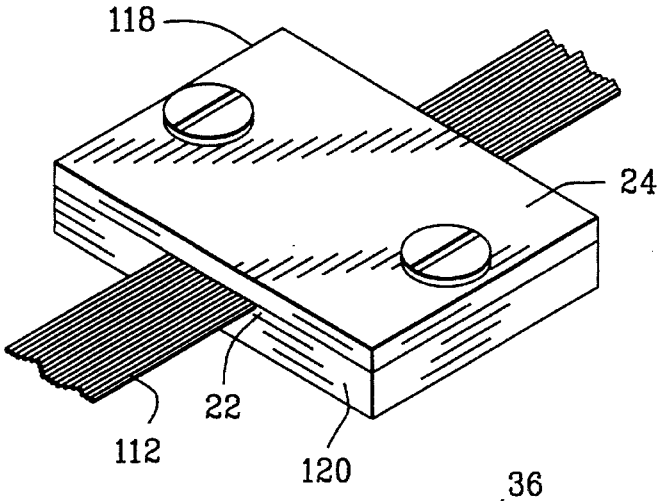
FIG. 1 is a perspective view of a tension device used to guide a multifilar ribbon when winding an output transformer in accordance with the present invention.
Figure 2:
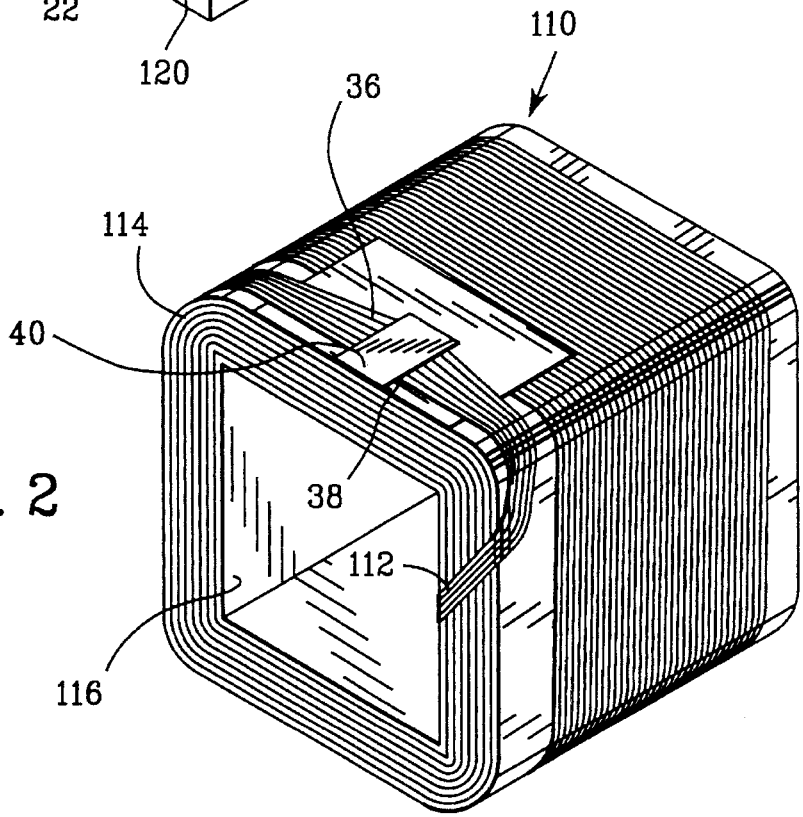
FIG. 2 is a perspective view of a wide band multifilar output transformer in accordance with the invention.

Referring to FIGS. 1 and 2, an output transformer 110 in accordance with the invention is made by winding a multifilar ribbon 112 side-by-side and in successive layers 114 around a bobbin 116. The multifilar ribbon 112 contains parallel wires having the same diameter which will constitute the primary and secondary windings of the output transformer 110.

Figure 4:
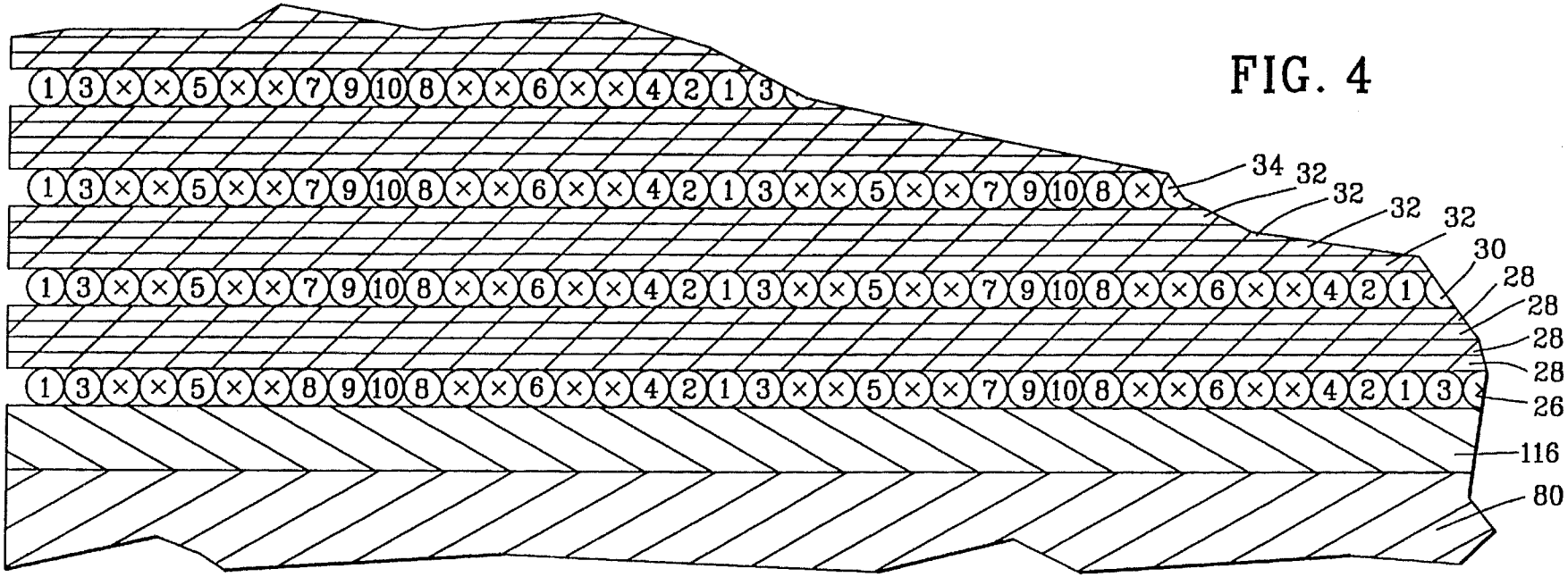
FIG. 4 is a partial cross sectional view taken through the layers of the transformer shown in FIG. 2.

A guide 118 is used to guide the wires in the multifilar ribbon 112 when the ribbon 112 is wound around the bobbin 116 to form the transformer 110. The guide 118 has a guide member 120 which has a rectangular slot 22 along its top surface. The rectangular slot 22 is dimensioned so that the wires in the multifilar ribbon 112 can be aligned single file across the slot 22. The dimensions of the slot 22 should be adjusted depending on the diameter of the wire and the number of wires used in the multifilar ribbon 112. An upper plate 24 can be screwed onto the lower guide plate 120 to clamp the wires of the multifilar ribbon into the slot 22. The multifilar ribbon 112 can then be wound around the bobbin 116 to form the transformer 110. As shown in FIG. 4, the multifilar ribbon is wound around the bobbin 116 side-by-side to form a first layer 26 of primary and secondary windings. Four layers 28 of 0.005 craft paper are laid on top of the first layer 26 of windings. A second layer 30 of primary and secondary windings is formed by winding the multifilar ribbon 112 side-by-side around the layers of craft paper 28. The craft paper 28 is an interleaving material separating the first 26 and the second 30 layers of windings. The layers 28 of craft paper not only separate the windings in the second layer 30 from the first layer 26 but also keep the layers of windings aligned. Another four layers of craft paper 32 are laid on top of the second layer 30 of windings, and the multifilar ribbon 112 is wound over the layers 32 of craft paper to form a third layer of windings 34. Successive layers of windings with interleaved layers of craft paper are wound around the bobbin 116 to obtain a transformer 110 with the proper turns ratio (e.g. 6 side-by-side windings of multifilar ribbon 112 per 16 layers). The transformer 110 is used around a magnetic core 80, and it is preferred that the magnetic core have a large cross-sectional area.

Referring to FIG. 2, when the outermost layer of windings has been wound, the trailing end of the multifilar ribbon 36 is connected with the beginning end 38 of the multifilar ribbon. The beginning end 38 of the multifilar ribbon is turned over so that the windings in the multifilar ribbon 12 are cross connected. The cross connection of the trailing end 36 and the beginning end 38 of the primary windings can be accomplished using a connector 40 as the depicted in FIG. 2.

Figure 3A:
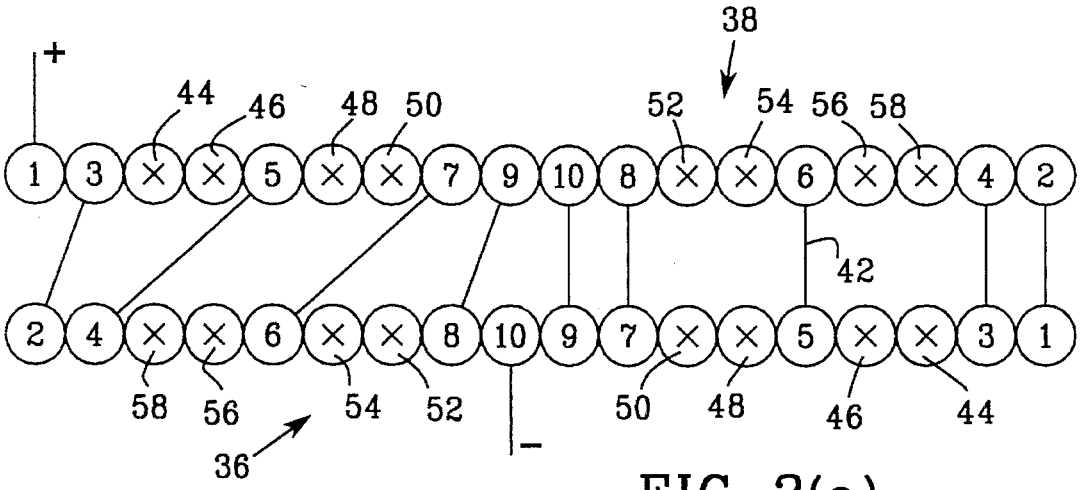
FIG. 3(*a*) is a schematic view showing the configuration of primary and secondary windings in a multifilar ribbon where the transformer turns ratio is 10:1.
Figure 3B:
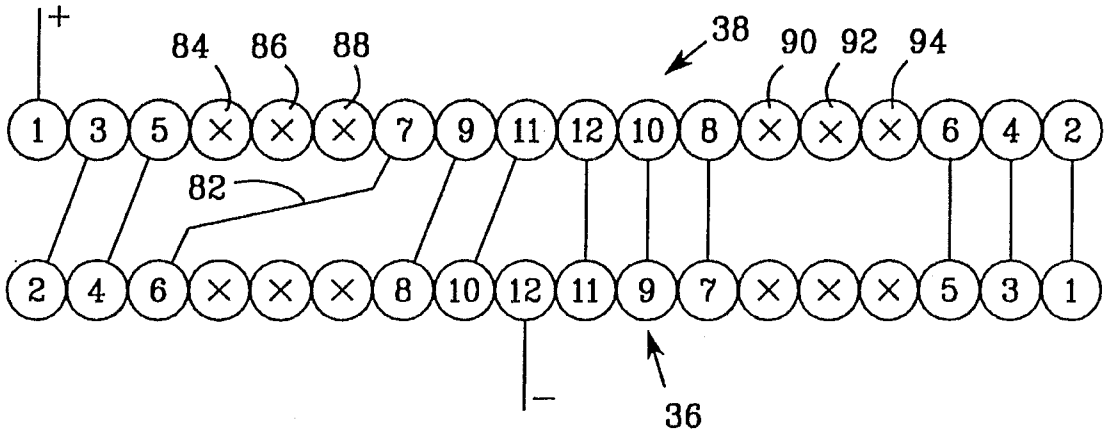
Figure 3C:
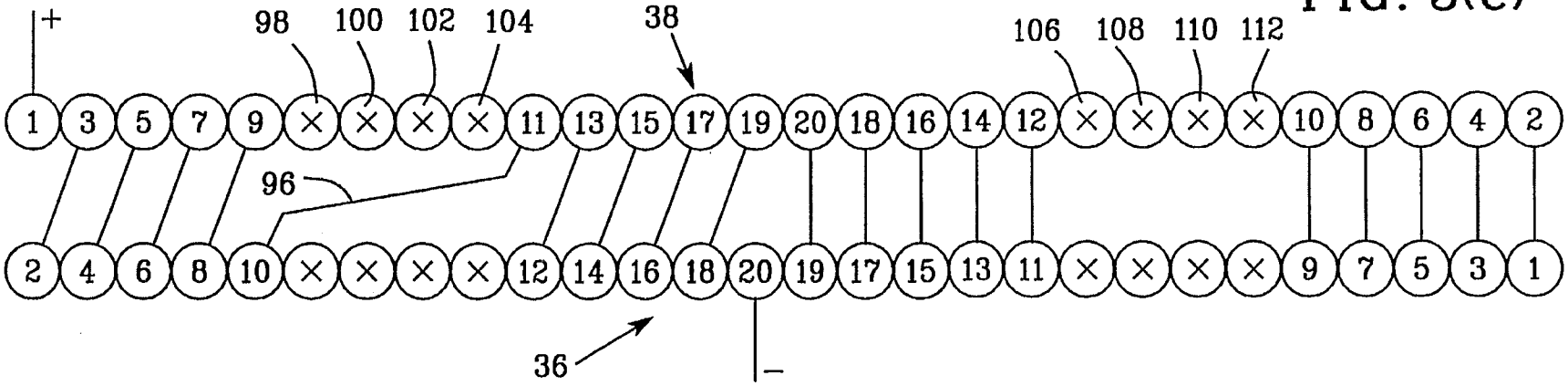

The cross connection of the beginning end 38 of the multifilar ribbon 112 and the trailing end 36 of the multifilar ribbon 112 for a transformer 110 with a 10:1 ratio as shown in FIG. 3(*a*). The windings in the beginning end 38 of the multifilar ribbon 112 are represented by the top row. The primary windings are numbered 1, 3, 5, 7, 9, 10, 8, 6, 4, 2 across the top row of the beginning end 38 of windings from left to right. The secondary windings which coexist in the multifilar ribbon 112 are represented by X. Note that the bottom row in FIG. 3(*a*) which represents the trailing end 36 of the multifilar ribbon 112 has the primary windings in reverse order from the top row because the ribbon 112 is turned. As illustrated, the first primary winding is connected in series to the second primary winding which is connected to the third primary winding which is connected to the fourth primary winding which is connected to the fifth primary winding which is connected to the sixth primary winding which is connected to the seventh primary winding which is connected to the eighth primary winding which is connected to the ninth primary winding which is connected to the tenth primary winding. The first primary winding, which preferably connects to a first half primary for a push-pull type vacuum tube audio amplifier, winds around the bobbin 116 several times in each layer (e.g. 6 side-by-side windings of multifilar ribbon 112 per layer), and then through each successive layer (e.g. 16 successive layers of multifilar ribbon 112) until the first primary winding re-enters the transformer 110 by an in-series connection to the second primary winding. Each of the primary windings winds around the transformer 110 in this manner and connects in-series with the next highest numbered winding, except for the tenth primary winding which preferably connects in-series to a second half primary in a push-pull vacuum tube audio amplifier after it winds through the transformer 110.

The number of series connected primary windings to the number of series or parallel connected secondary windings is the turns ratio for the transformer 110. Enough primary windings must be used to prevent the AC potential between windings from becoming too high so that the effect of capacitance between the windings can be minimized. Also, there should be enough secondary windings in the multifilar ribbon to provide sufficient current handling capacity and to also provide sufficient coupling between the primary windings and the secondary windings. It is preferred that the secondary windings be wound adjacent to the primary windings which are connected to the center tap 42 or ground to reduce AC potential differences. The center tap 42 of the primary windings shown in FIG. 3(*a*) is between the fifth and the sixth primary windings. The secondary windings have been labeled with reference numbers in FIG. 3(*a*) such that a first secondary winding is 44, a second secondary winding is 46, a third secondary winding is 48, a fourth secondary winding is 50, a fifth secondary winding is 52, a sixth secondary winding is 54, a seventh secondary winding is 56, and an eighth secondary winding is 58. The second secondary winding 46 and the third secondary winding 48 are adjacent to the fifth primary winding which should have a low potential because it is grounded by the center tap 42. Likewise, the sixth secondary winding 54 and the seventh secondary winding 56 are adjacent to the sixth primary winding. The other secondary windings 44, 50, 52 and 58 are located adjacent to the secondary windings 46, 48, 54 and 56, respectively. Note that the secondary windings 44, 46, 48, 50, 52, 54, 56, and 58 are also located so that the distribution of primary windings throughout the multifilar ribbon is symmetrical. Referring to FIG. 5, the primary windings 1 through 10 are connected in series while the secondary windings 44, 46, 48, 50, 52, 54, 56 and 58 are connected in parallel. Lead wires 60 and 62 electrically connect the secondary windings to the speaker load. FIG. 5 also illustrates that the secondary windings are located in the multifilar ribbon adjacent to the fifth and sixth primary windings, which are connected to the center tap of 42 which is grounded; and that the secondary windings 44, 46, 48, and 50 are located symmetrical to the secondary windings 52, 54, 56 and 58. FIG. 5 is illustrative and in actual use current would travel through all of the primary windings in the same direction.

Figure 8:
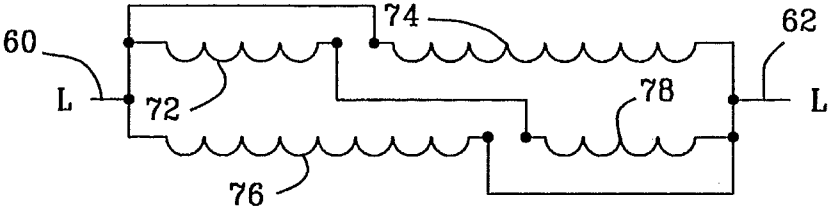
FIG. 8 is a schematic diagram representing the electrical connections of secondary windings for a 3.5 ohms speaker load.
Figure 7:
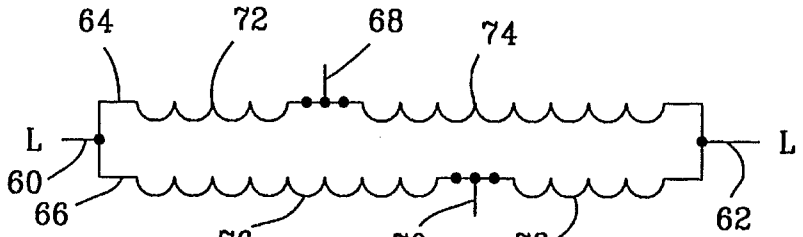
FIG. 7 is a schematic drawing representing the electrical connection of secondary, windings for an 8 ohms speaker load.

Referring to FIGS. 7 and 8, the electrical connection of the secondary windings can be modified to adjust the number of secondary windings considered for determining the turns ratio of the transformer 110 while at the same time using all of the wire of the secondary windings. It is important to continue using all of the wire of the secondary windings so that there is proper coupling between the primary and secondary windings. In FIG. 7, a first group of secondary windings 64 corresponds to secondary windings 52, 54, 56 and 58 shown in FIG. 5. A second group of secondary windings 66 corresponds to secondary windings 44, 46, 48 and 50 shown in FIG. 5. The first group 64 of secondary windings have a first secondary winding tap 68 that is located after the first group 64 of secondary winding has made ⅓ of the total turns of the secondary windings. In the preferred embodiment, the secondary windings make 96 turns (i.e. 6 rows of multifilar ribbon 12 side by side for 16 successive layers). A first portion 72 of the first group 64 of secondary windings is located before the first secondary winding tap 68 and contains 32 turns. A second portion 74 of the first group 64 secondary windings is located after the first secondary winding tap 68 and contains 64 turns.

The second group of secondary windings 66 has a second secondary winding tap 70 which is after the second group of winding 66 has made ⅔ of the total turns of secondary windings. A first portion 76 of the second group 66 of secondary windings is located before the second secondary winding tap 70 and contains 64 turns. A second portion 78 of the second group of secondary winding 66 is located after the second secondary winding tap 70 and contains 32 turns. When the transformer 110 is designed to have a turns ratio of 10:1 and uses a multifilar ribbon 112 as shown in FIGS. 3(*a*), 4 and 5, the configuration shown in FIG. 10 is appropriate for an 8 ohm speaker load.

Referring to FIG. 8, the secondary windings shown in FIG. 8 can be connected differently for a 3.5 ohm speaker load. In particular, the first portion 72 of the first group 64 primary windings can be connected with the second portion 78 of the second group of secondary windings 66. Then the second portion 74 of the first group 64 primary windings can be connected in parallel with the first portion 76 of the second group 66 of primary windings and in parallel with the series connected first portion 72 of the first group 64 and the second portion 78 of the second group 66 secondary windings. In this manner, there are 3 parallel groups of windings, each having 64 turns. The configuration in FIG. 8 results in the utilization of all the wire in the secondary windings with only a slight increase in leakage inductance. It should be apparent to one skilled in the art that the same could be done with other configurations, however the configurations shown in FIGS. 7 and 8 requires only one tap for each group 64 or 66 of secondary windings.

The transformer 110 as described so far with a 10:1 ratio has only one resonant frequency, at about 500 khz. The transformer 110 has no other peaks or resonance modes as with other audio output transformers, which usually have two different resonance frequencies that can cause instability especially when used with feedback from the output transformer secondary.

Also, a transformer 110 that is wound as described herein, results in tight coupling between the primary windings and the secondary windings. This is because the primary and secondary windings are side by side in the multifilar ribbon 112, where ordinary wide band transformers increase coupling by sandwiching alternating layers of primary windings and secondary windings. Distributed capacitance is reduced in the transformer 110 by using triple build magnet wire and thick interleaving material between layers. This does not adversely affect the leakage inductance, because coupling is provided by the multifilar ribbon 112. The capacitance associated with the multifilar ribbon are in series, and as a result, is reduced by about three times of that of two adjacent wires. Also, the total AC potential of the primary windings is divided by the number of primary windings involved, and the secondary windings are adjacent to the low potential primary windings.

The 10:1 transformer 110 under small signal test has shown a response of 6 to 450 kc at –6 db. Also, the phase shift in the 10:1 transformer 110 is less than 2° up yo 200 k, and only 12° at 200 kc. Tests with amplifiers have shown that the 10:1 transformer 110 can provide nearly 60 db of feedback from the transformer secondary without regeneration. This should result in better stability and less distortion.

The winding concept as described above for the 10:1 turns ratio transformer 110 can also be applied to transformers having other turns ratios. For instance, FIGS. 3(*b*) and 6 represent a transformer 10 with a 12:1 turns ratio. Such a transformer has a multifilar ribbon 112 with 12 primary windings and 6 secondary windings. A center tap 82 is between the 6th and 7th primary windings. A first group of secondary windings 84, 86 and 88 are located adjacent to the 7th primary winding, and a second group of secondary windings 90, 92 and 94 are located adjacent to the 6th primary winding. Again, the secondary windings are located close to the low potential primary windings and symmetric within the multifilar ribbon 12. The first and second group of secondary windings shown in FIG. 3(*b*) can be connected and reconnected as illustrated in FIGS. 7 and 8, to accompany various speaker loads. Note that the first primary winding is electrically connected to a first half primary, while the twelfth primary winding is electrically connected to a second half primary. The cross connections between the primary windings in FIG. 3(*b*) is similar to that shown in FIG. 3(*a*). FIG. 6 is illustrative like FIG. 5, and in actual use current would travel through all of the primary windings in the same direction.

FIG. 3(*c*) shows the configuration of a multifilar ribbon 112 and the electrical connections for the primary windings in a transformer 110 having a 20:1 turns ratio. A center tap 96 is located between the tenth and eleventh primary windings. A first group of secondary windings 98, 100, 102 and 104 are located adjacent to the eleventh primary winding. A second group of secondary windings 106, 108, 110 and 112 are located adjacent to the tenth primary winding. The first primary winding is connected to the first half primary and the twentieth primary winding is connected to the second half primary. Note that the secondary windings are again located symmetrically within the multifilar ribbon 112. A transformer 110 with a 20:1 turns ratio in the configuration of FIG. 3(*c*) was tested in a system having a primary impedance of 3,200 ohms. The leakage inductance is somewhat increased, but is still less than ⅓ of the best conventionally wound transformer I have tested. Also, the half primary to half primary leakage inductance is only slightly higher than the 10:1 and 12:1 transformers.

It is recognized that various equivalents, alternatives, and modifications are possible and should be considered within the scope of the appended claims.

I claim:

1. A wide band audio transformer comprising:

a common core;

a plurality of continuous magnet wires wound simultaneously as a multifilar ribbon resulting in a plurality of ribbon turns in each of several successive layers, each magnet wire making a plurality of continuous turns per layer, and each layer being separated by insulating material;

the ribbon containing two primary groups of wires, each primary group representing a half primary for a push-pull circuit, and two secondary groups of wires, the wires of each primary group are connected in series re-entry so that after the first winding of the primary group each successive primary winding alternates away therefrom, and the wires of the secondary groups are connected in parallel.

* * * * *